United States Patent [19]

Adams et al.

[11] 3,961,671

[45] June 8, 1976

[54] EARTH ANCHOR DRIVE PROCESS

[76] Inventors: James R. Adams, 1125 E. Vandiver; James K. Adams, Rte. No. 10, both of Columbia, Mo. 65201

[22] Filed: Sept. 3, 1974

[21] Appl. No.: 502,982

[52] U.S. Cl. ..... 173/1; 52/742; 61/53.68; 173/163; 175/19; 175/57

[51] Int. Cl.[2] ..... E02D 7/22; E02D 5/80

[58] Field of Search ..... 173/163, 1; 175/19, 175/57, 170, 323; 52/157, 742; 73/84; 310/50, 166, 211; 61/53.68

[56] References Cited

UNITED STATES PATENTS

| | | | |
|---|---|---|---|
| 1,203,138 | 10/1916 | Schuler | 310/50 UX |
| 2,569,528 | 10/1951 | Kandle | 52/157 X |
| 2,975,848 | 3/1961 | Roberts | 173/163 |
| 3,032,126 | 5/1962 | Rexine | 175/170 X |
| 3,177,736 | 4/1965 | Kilmartin et al. | 173/163 X |
| 3,429,386 | 2/1969 | Secrist et al. | 173/163 |
| 3,465,181 | 9/1969 | Colby et al. | 310/211 X |
| 3,645,055 | 2/1972 | Roza | 52/157 X |
| 3,662,195 | 5/1972 | Wielt | 310/211 X |
| 3,830,315 | 8/1974 | Love | 52/157 X |
| 3,832,861 | 9/1974 | Jahnke | 52/157 X |

*Primary Examiner*—Ernest R. Purser
*Assistant Examiner*—William F. Pate, III
*Attorney, Agent, or Firm*—J. Philip Polster

[57] ABSTRACT

A medium duty earth anchor of the type having one or two single turn helixes near the lower end of a rod is driven into the earth by means of a hand-held drive tool having a vertical quarter horsepower split phase motor, a step-down gear train which reduces the drive speed to 6 r.p.m., and a vertical socket which drivingly engages the head of the rod.

11 Claims, 4 Drawing Figures

FIG. 1.
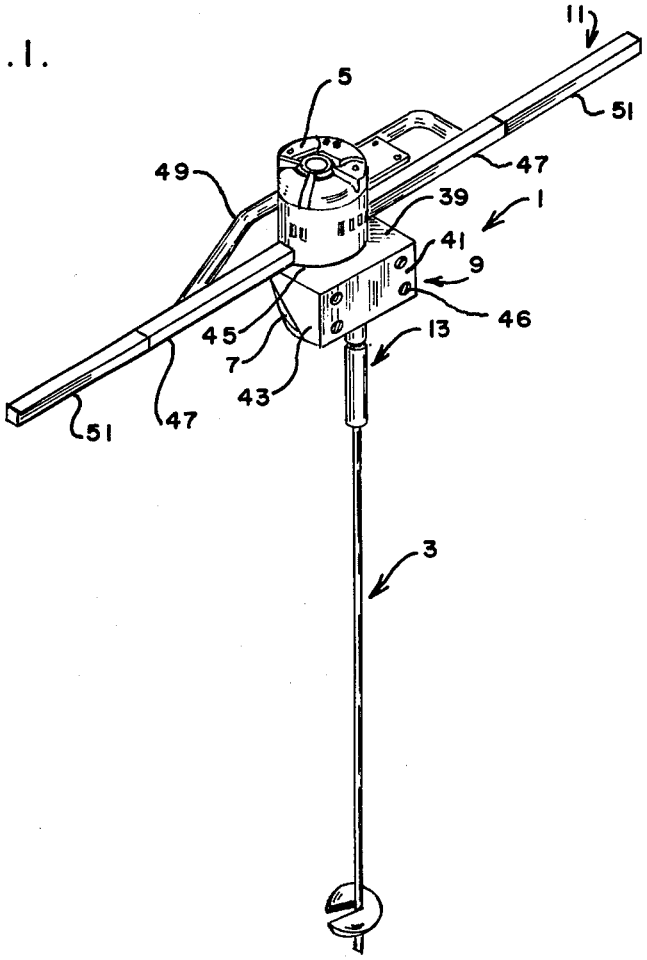
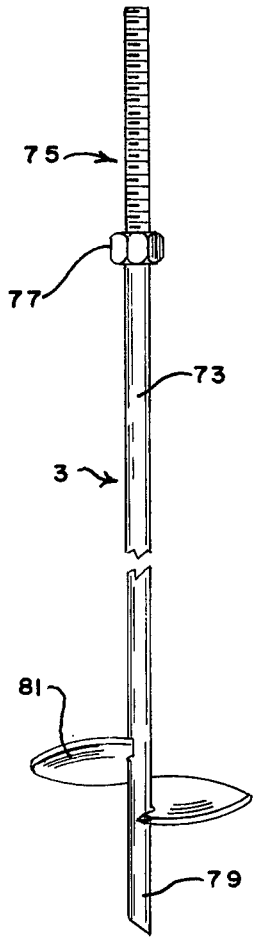
FIG. 3.
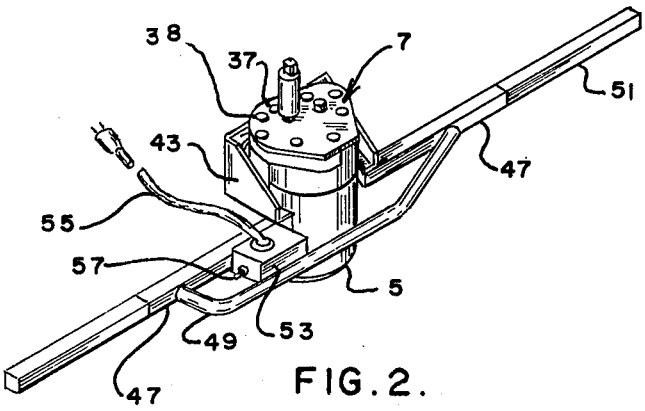
FIG. 2.

EARTH ANCHOR DRIVE PROCESS

BACKGROUND OF THE INVENTION

This invention relates to the driving of earth anchors into the earth, and in particular to an improved method and drive tool for driving medium duty earth anchors. Medium duty earth anchors have a number of uses in supporting and stabilizing static structures. Probably their most common use today is in anchoring mobile homes, although they are also used for anchoring or guying a wide variety of other structures.

A "medium duty earth anchor" includes a guy rod having a diameter of from about one-half to about three quarters inch and a length of from 3 to 5 feet, and a single turn helix, having a diameter from about 4 to about 8 inches, near the lower end of the rod.

The rod is typically made of carbon steel (0.20% to 0.40% carbon: SAE 1020 to 1040). The lower end of the rod is generally pointed and the head of the rod is provided with some sort of attachment means for attaching the anchor to a guy wire, strap or the like. The attachment means may be an eye or buckle or may simply be a screw thread or the like to which a fastener may be attached.

The helix is conventionally a sheet metal disc about one-eighth to three-sixteenths inches thick, having a radial split and being bent to form a single turn screw thread. The pitch of the helix, that is, the axial distance between the edges of the radial split, is from about 1 to 3 inches. The pitch of a 6 inch helix is typically about 1¾ inches at the guy rod and 2 inches at the circumference of the disc. The helix is typically spaced about 2 inches from the sharpened lower end of the guy rod. Some anchors include a second helix spaced perhaps 4½ inches above the lower helix. The configuration of the helix may vary somewhat from that described, and is not critical to the present invention.

Medium duty anchors are well known and are commercially available from numerous manufacturers.

The installation of medium duty earth anchors has proven difficult. The anchors are too large for easy installation with a hand-held lever bar. The large, truck-mounted drilling equipment used for driving heavy-duty utility anchors, however, is also impractical; many jobs simply do not require installation of enough anchors to justify bringing in large equipment, and the space available frequently precludes its use.

In recent years hand-held electric drive tools have been used for driving medium-duty anchors. For the most part, these tools have been pipe threaders equipped with special adapters for driving earth anchors. These drivers include the usual horizontal handle and horizontal universal (AC-DC) motor. The motor drives a worm which in turn drives a ring gear. As is well known, the universal motor has a high shaft speed, 3500 rpm or more, which is reduced by the gearing to a ring gear speed of from about 14 to 26 rpm. The motor may be from about ½ to 1 horsepower. A slip-through adapter in the ring gear converts the pipe threader to an anchor driver. The adapter may engage the head of the anchor or may be of the type which extends the length of the anchor rod and drives the upper edge of the disc itself. The adaptation of the pipe threader may also include the addition of a second handle, for two-man operation.

Although such electric drive tools are in general use today, they are a far from satisfactory approach to driving medium duty anchors. The anchor frequently strikes obstructions in the ground, such as rocks and roots, and often hangs up on them. When it does, the shock throws the operators off balance and sometimes causes them injuries. When the anchor hangs up, it must be backed out a way and driven again, in hopes of missing the obstruction. Many times, the anchor must be extracted and started anew, or a new anchor used if the first is bent beyond use. Although anchors driven by prior anchor driving means occasionally cut through obstructions on which they hang up, this is not always advantageous as when the obstruction is a buried pipe or electrical cable.

Another problem with previously known electric anchor drivers has been their extremely short life. The gears are stripped or the motor is burned out with discouraging regularity.

A number of governmental agencies have specified minimum holding power for mobile home anchors. The specifications have not always been met with prior driving tools when the soil has provided less than perfect holding qualities.

SUMMARY OF THE INVENTION

One of the objects of this invention is to provide a method and drive tool for driving medium duty earth anchors in such a way as to provide greater holding power than has heretofore been obtainable.

Another object is to provide such a method and driver which greatly reduce the anchor's tendency to hang up on obstructions.

Another object is to provide such a method and driver which cause far less strain on driver and operator.

Another object is to provide such a method and driver which will generally insert anchors in as little time as with prior means, often in less.

Yet another object is to provide a simple, rugged, and long-lived driver.

Other objects will become apparent to those skilled in the art in light of the following description and accompanying drawings.

In accordance with this invention, generally stated, a method of driving a medium duty anchor is provided which comprises engaging the head of the anchor with an electric motor-powered drive tool at a distance of at least 2 feet from the helix of the anchor and driving the anchor at a speed no more than 10 rpm, preferably about 6 rpm. The preferred drive tool includes a small induction motor, preferably about one quarter horsepower, a gear train made up entirely of spur and helical gears, the output shaft of the gear train being parallel to the shaft of the motor, and engagement means for engaging the head of the anchor, the engagement means preferably including a pair of socket parts forming a limitedly flexible coupling.

BRIEF DESCRIPTION OF THE DRAWINGS

In the drawings, FIG. 1 is a view in perspective of the preferred embodiment of anchor driver of this invention, connected to a typical medium duty earth anchor for use in the method of the invention;

FIG. 2 is a view in perspective of the driver of FIG. 1, shown inverted and with its anchor-engaging socket removed;

FIG. 3 is a view in elevation of a typical medium duty anchor; and

DESCRIPTION OF THE PREFERRED EMBODIMENT

Figure 4:
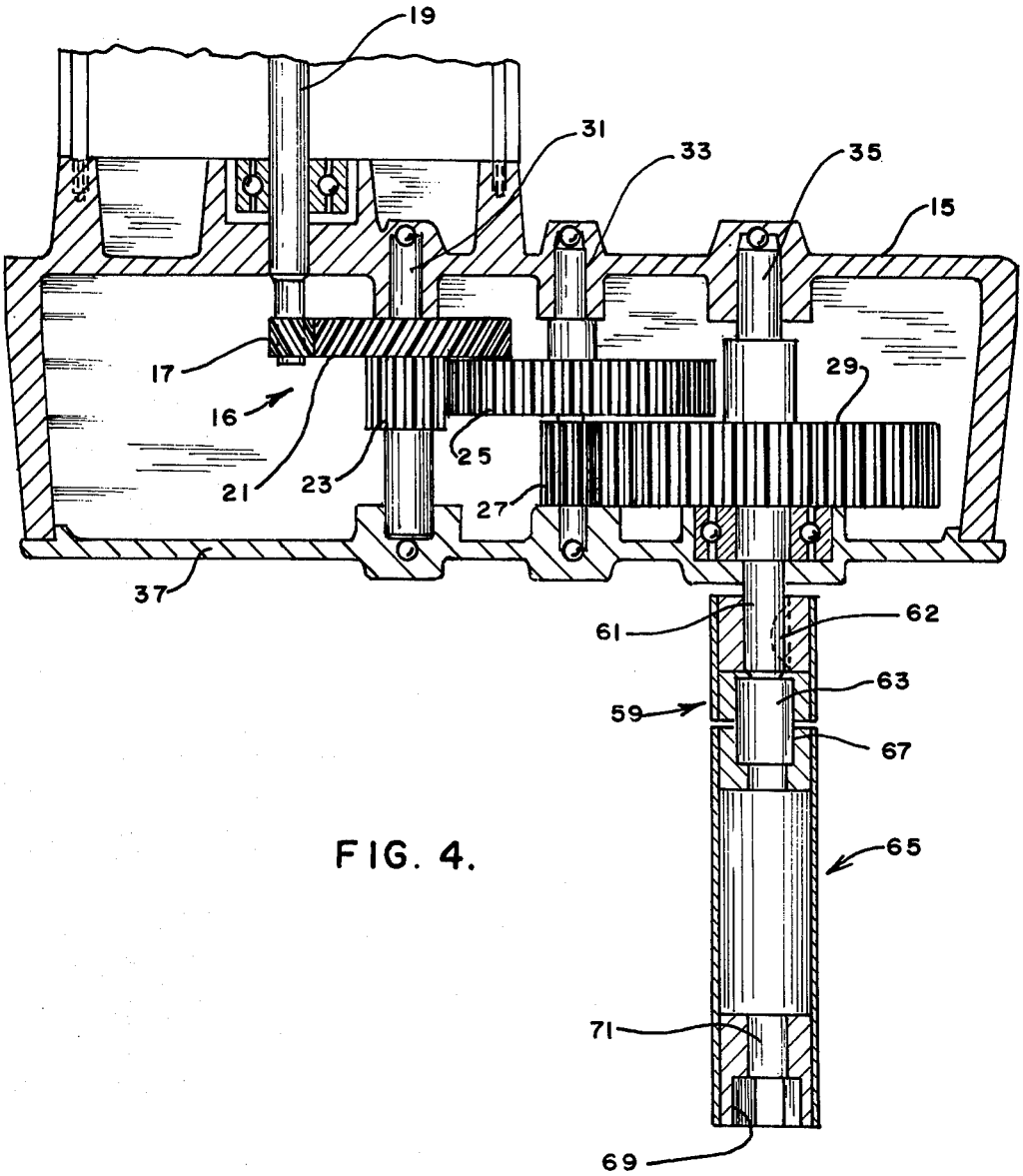
FIG. 4 is a sectional view of the gear box and socket to show the gears more clearly.

Referring now to the drawings, reference numeral 1 indicates one illustrative embodiment of earth anchor driver of this invention, for use in a method of driving a medium duty anchor such as the anchor designated by the numeral 3.

The driver 1 includes an induction motor 5, a gear box 7, a support bracket 9, handle means 11, and engagement means 13 for holding the head of the anchor 3.

The motor 5 is a quarter horsepower split phase motor having a rated (full load) speed of 1725 revolutions per minute. It draws about 4.6 amps at rated load and 120 volts. The motor is easily reversible by reversing the leads of the main or aux windings through a simple reversing switch, and it provides full power in either direction of rotation. Its speed-torque curve is typical of induction motors, reaching maximum torque of about 230% full load torque at about 75% synchronous speed.

The gear box 7 is secured to the motor 5, and as shown in FIG. 4, the upper part 15 of the box 7 may be cast integral with the lower end shield of the motor 5. The step-down gear train 16 within the gear box 7 includes a helical gear 17 cut in the rotor shaft 19 of the motor 5 and a mating helical gear 21. The remainder of the gears 23, 25, 27 and 29 are spur gears. The shafts 31, 33 and 35 of the gear train are all parallel with the rotor shaft 19 and are journaled in the upper casing part 15 and in a lower cover part 37. The cover plate 37 is secured to the upper casing part 15 by screws 38. The gear train 16 provides a speed reduction of 288:1, or a speed of output shaft 35 of 6 rpm at the rated speed of 1725 rpm of the motor shaft 19.

The support bracket 9 is in the form of a four sided box having a top wall 39, a front wall 41, and side walls 43. The free edge of the top wall 39 is cut away in a semi-circle 45 to fit the vertical cylindrical casing of the motor 5, and the front wall 41 is bolted to the gear box 7 by tapped bolts 46.

The handle means 11 include a pair of handles 47 welded to the upper wall 39 of the bracket 9 and a stabilizing bar 49 welded at its ends to the handles 47. Handle extensions 51 extend the total length of the handle means to 5 feet. The handle extensions 51 slip fit into the ends of the handles 47.

A junction box 53 is mounted between stabilizing bar 49 and one of the handles 47. Electric cord 55 is connected through an on-off spring-loaded toggle switch 57 and through a forward-reverse selector switch to the motor 5. The switches are mounted on opposite ends of the junction box 53.

The engagement means 13 include an adapter 59 secured to the lower end 61 of the output shaft 35 by a Woodruff key 62. The lower end of the adapter is a square shank 63. The engagement means 13 also include a socket 65, the upper end of which is provided with a square socket part 67, for receiving the end of the shank 63. The depth of the square socket part 67 is chosen to allow about one-eighth of an inch space between the adapter 59 and the socket 65, thereby allowing a very small amount of play between the two parts of the engagement means. The lower end of the socket 65 is provided with a hexagonal socket part 69 and a circular bore 71 for receiving the head of the illustrative anchor 3 as hereinafter described.

The anchor 3 is typical of the type of medium duty anchor for which the present invention is particularly adapted. It includes a guy rod 73 made of SAE 1040 steel and having a length of 54 inches and a diameter of eleven-sixteenths inch. The head 75 of the rod 73 is threaded to receive a strap head or other fastener, and at the lower end of the threads, about 6 inches from the top of the rod, a hex nut 77 is welded to the rod 73. The lower end 79 of the rod is sharpened and acts as a leader and guide for the anchor. A helix 81 is welded to the rod 73 about 2½ inches from the lower end of the rod. The helix has a diameter of 6 inches and a pitch of about 2 inches at its circumference, about one quarter of an inch less at the rod.

The method of driving anchors with the driver of this invention requires simply that the head 75 of the rod be inserted in the socket 65 with the hex nut 77 snugly engaged by the hexagonal socket part 69 and the threaded head of the rod extending into the bore 71. Two men then lift the combined driver and anchor into a position to drive the anchor at the desired angle, each man holding one of the handles 47 or extensions 51. The angle at which the rod is held will generally be nearly vertical, although a more oblique angle may sometimes be necessary, as when the anchor must be angled under a cement slab. One operator then presses the toggle switch 57 to start the driver 1 and drive the anchor 3 into the earth.

It has been found that the seemingly impractical low rotational speed of this invention actually produces none of the expected drawbacks and provides a number of unexpected advantages.

At a speed of 6 rpm, the anchor helix bites into the soil cleanly and disturbs the soil less than with prior methods. In fact, the anchor draws itself into the earth a distance virtually equal to the full pitch of the helix for each revolution of the anchor. Thus, the anchor is driven a full 48 inches into the earth in about four minutes. By comparison, at the 26 rpm speed of a prior art device, the anchor is inserted only about 1½ inches per revolution. Therefore, in an ideal soil which contained no obstructions and which offered so little resistance to the anchors that the universal motor of the prior art device ran at substantially synchronous speed, the prior art device would insert an anchor about 2¾ minutes faster than the drive tool 1. In the overall job of anchoring mobile homes this time difference is not particularly significant. Such soil is extremely rare.

In the more usually encountered soils, the driver 1 inserts anchors faster than prior art devices, and the worse the soil the more marked is the improvement. This increased speed in practical operation is directly attributable to the decreased speed of the drive tool, as well as to the type of motor and gear train utilized. At the reduced speed of the present method, the chances of striking an obstruction are reduced because the helix cuts through an area equal to little more than its thickness (about 3/16 inch). Striking an obstruction is also less likely to slow the insertion job. Because of its gearing and the speed-torque characteristics of a split phase induction motor, the quarter horsepower motor 5 provides sufficient torque to twist the anchor rod 73 beyond its elastic limit (about 350 ft. lbs.) without substantially slowing its rate of rotation, should the anchor helix strike an obstruction. A ¾ horsepower universal motor geared to a rated speed of 26 rpm must slow nearly to half speed to provide this torque. More importantly, it has been found that at 6 rpm the helix does not usually bite into the obstructions it strikes, but instead works around them as the anchor rod is twisted and bent above it. Therefore, the anchor is usually inserted in a single operation without the frequent stoppages for backing out the anchor which have previously characterized driving medium-duty anchors.

At the low speed of the present invention, no substantial shock load is transmitted through the anchor rod when the anchor strikes an obstruction. Instead, the head of the rod continues to turn and the load is stored in the rod as a generally uniform torsional stress. The split phase motor 5 exerts its maximum torque at about 1350 rpm. If the rod does not shear when the motor slows to that speed, the motor stalls and its rotation is automatically reversed by the unwinding of the torsion rod to which it is attached. In fact, if the spring-loaded toggle switch 57 is not released when the motor 5 stalls, the motor 5 will continue to rotate in reverse and will back the anchor out because the gear train operates equally efficiently in either direction. Therefore, unlike a universal motor, which exerts maximum torque at stall, the induction motor 5 is protected against burn out.

The quarter horsepower induction motor 5 does not draw excessive current or overheat even when it is on the hundred foot extension cord commonly required on anchor driving jobs. Therefore, even though the motor 5 is substantially undersized compared with the universal motors of prior anchor drivers and even though single phase induction motors (particularly split phase motors) are noted for being inappropriate for high inertia loads, the motor 5 has proven superior to those of the prior art devices.

The vertical split phase motor 5 and the gear train 16 of helical and spur gears (gear wheels) provide full power in either the forward or the reverse setting of the selector switch. They also provide a better balanced tool than prior drivers.

One of the most important advantages of the lower speed is that it increases the holding power of the installed anchor. Even in the best soil (fibrous, black soil), an anchor inserted in accordance with the present invention at 6 rpm with the driver 1 has been found to have about 500 pounds more holding power than a similar anchor inserted at 26 rpm with a prior art driver. In more typical soil the relative holding power is even greater because the anchor has been backed out and reinserted far less, hence the soil has been disturbed far less.

Numerous variations, within the scope of the appended claims, will be apparent to those skilled in the art in light of the foregoing description. For example, although a drive speed of 6 rpm is preferred, speeds up to about ten rpm are usable and provide many of the advantages of the present invention, although the advantages are less pronounced as the speed increases. About 10 rpm a larger motor is required to provide adequate torque, the tendency of the anchor to hang up shows a marked increase, and the shock load transmitted through the rod when the anchor hits an obstruction becomes objectionable. Lower speeds are also useable, although they are not believed to provide substantial advantages over the preferred speed and do increase the time consumed in driving the anchors. As previously mentioned, the driver 1 may be used with other anchors than the illustrative anchor 3, the only modification usually necessary being replacement of socket 65 with a part adapted to engage the head of the other anchor. These variations are merely illustrative.

We claim:

1. A method of inserting into the earth an earth anchor having a rod with a diameter of from about ½ to about ¾ inch and a length of from about 3 feet to about 5 feet, and having toward the normally lower end of said rod a single turn helix with a diameter of from about 4 to 8 inches and a pitch of from about 1 to 3 inches, said method utilizing a hand-held electric motor-powered drive tool, said method comprising forming a driving connection between said drive tool and the upper end of said rod at a distance of at least 2 feet from said helix, and driving said anchor into the earth at a rotational speed which at no time exceeds 10 revolutions per minute.

2. The method of claim 1 wherein the drive tool exerts a torque in excess of 350 foot pounds at a speed of at least 70 percent of the no-load speed of the drive tool.

3. The method of claim 1 wherein said anchor is driven into the earth at a rotational speed of from about 5 to 7 rpm.

4. The method of claim 2 wherein said anchor is driven at a speed of from 5 to 10 rpm at the no-load speed of the drive tool.

5. The method of claim 2 wherein the drive tool drives the upper end of said rod at a speed which at no time is less than 4 revolutions per minute, regardless of the speed of said helix.

6. The method of claim 1 wherein said drive tool comprises an AC induction motor having a rated speed of less than 1,800 r.p.m., and a rated power of no more than one-half horsepower, said induction motor having a generally vertical rotor shaft.

7. The method of claim 6 wherein said induction motor and said gear train operate with substantially equal speed and efficiency in a forward direction and in a reverse direction.

8. The method of claim 7 wherein said anchor rod stores sufficient torsional energy in itself as said anchor in inserted into the ground to reverse the direction of rotation of said motor when said motor slows to a speed of less than about 70 percent of its synchronous speed.

9. The method of claim 6 wherein said drive tool includes a gear box secured to said induction motor, said gear box comprising a gear train connecting said rotor shaft to a generally vertical output shaft.

10. The method of claim 9 wherein said drive tool further comprises a support bracket including a generally vertical plate secured to said gear box, and wherein said drive tool further comprises handle means including a pair of generally horizontal handles attached to said support bracket.

11. The method of claim 10 wherein said support bracket and said handle means encompass said motor and said gear box.

* * * * *